United States Patent [19]

Bauer

[11] 4,001,548

[45] Jan. 4, 1977

[54] HEATING APPARATUS FOR THE HEAT TREATMENT OF YARNS

[75] Inventor: Karl Bauer, Remscheid, Germany

[73] Assignee: Barmag Barmer Maschinenfabrik Aktiengesellschaft, Wuppertal, Germany

[22] Filed: Sept. 20, 1974

[21] Appl. No.: 507,779

[30] Foreign Application Priority Data

Sept. 26, 1973 Germany ..... 2348371

[52] U.S. Cl. ..... 219/388; 28/62; 57/34 HS; 165/105; 219/341; 219/530

[51] Int. Cl.[2] ..... H05B 3/00; F27B 9/08; D02J 13/00; F28D 15/00

[58] Field of Search ..... 219/326, 341, 388, 401, 219/439, 523, 530, 540; 165/105, 139, 159; 28/62; 57/34 HS; 34/155

[56] References Cited

UNITED STATES PATENTS

| | | | |
|---|---|---|---|
| 1,276,573 | 8/1918 | Rohan | 219/341 |
| 2,266,017 | 12/1941 | Fisher | 219/341 X |
| 3,272,965 | 9/1966 | Reichalt | 219/240 |
| 3,298,430 | 1/1967 | Kodaira | 165/105 |
| 3,395,433 | 8/1968 | Kodaira et al. | 28/62 |
| 3,410,339 | 11/1968 | Wiegandt | 165/105 |
| 3,603,767 | 9/1971 | Scicchitano | 219/439 |
| 3,638,411 | 2/1972 | Tsugawa et al. | 57/34 HS |
| 3,728,518 | 4/1973 | Kodaira | 219/326 |
| 3,770,051 | 11/1973 | Kodaira | 165/105 |
| 3,860,386 | 1/1975 | Kodaira | 219/388 |
| 3,879,599 | 4/1975 | Kodaira | 219/326 |
| 3,902,046 | 8/1975 | Oi | 219/388 |

*Primary Examiner*—A. Bartis
*Attorney, Agent, or Firm*—Johnston, Keil, Thompson & Shurtleff

[57] ABSTRACT

Heating apparatus for the heat treatment of synthetic yarns having a lower evaporator zone partially filled with a liquid, vaporizable heat transfer mechanism. The hot vapors of the medium heat a plurality of straight or convexly curved profile tubes having yarn contact surface or a plurality of thread guide tubes inside heating jacket tubes. The vapors are condensed in an upper condenser. Branch tube lines communicate the profile or jacket tubes with the evaporator and the condenser. One or more return lines return the condensate from the condenser to the evaporator. The evaporator has transverse baffle plate walls at spaced, axial intervals, which walls are at least substantially coextensive with the entire liquid-moistened portion of the evaporator zone for effectively damping any liquid pressure waves created in the evaporator. Recesses in the damper plate walls allow liquid flow between zones between respective baffle plate walls. Heating elements, such as electrical resistance heating members, extend in the axial direction of the evaporator and may be surrounded by perforate members which, in turn, may be filled with metal pieces, such as wire coils, lath shavings, or metal cuttings.

7 Claims, 6 Drawing Figures

HEATING APPARATUS FOR THE HEAT TREATMENT OF YARNS

INTRODUCTION

Heating arrangements of the type described above are in themselves known and have been used for a number of years successfully in textile machines, primarily false-twist crimping devices, and serve for the heat treatment of the synthetic yarns, especially for the thermofixing of the twist introduced into the thermoplastic yarns.

The advantage of the heating systems of this invention over the known heating arrangements having a heat-transfer liquid circulated in a closed evaporator zone or using direct electrical resistance heating of the yarn contact surfaces or the like, lies essentially in that, without great expenditure on regulating devices and controls, all the heat consumers can be maintained at a very uniformly and finely adjustable temperature level. Within certain limits, differences in heat consumption between the individual consumers, by reason of the high heattransfer coefficients of the condensing vapors, do not have a detectable effect despite non-uniform flow of the heat transfer agent vapor or the variations in pressure losses as a consequence of pipe friction. The precondition for such a saturated vapor heating system with a very precise uniformity of temperature control guidance, however, is (1) that there be removed from the system all the inert gases or vapors, even if they arise only through aging or cracking of the heat transfer fluid, and (2) that for the heat transfer fluid itself is kept very pure.

It has proved, however, that even with the improvement of the preconditions mentioned, especially with regard to the purity of the heat transfer fluid used, difficulties set in in an unexpected manner. Thus, exact recordings of the temperature fluctuations in the vapor space of such a heating system showed an inadmissibly high fluctuation, namely from about 3° to 4° C. A fluctuation of at most 0.5° C should have been possible to achieve because of the clear and unambiguous calculatability of the saturated vapor temperature and surface tension of the heat transfer fluid. In such heating systems a certain desired temperature value was prescribed. The regulation of the electric resistance heating elements, which brought about the evaporation of the required amounts of the heat transfer medium, was accomplished by a temperature regulator.

Since, despite a predetermined low heat surface load, the temperature of the medium had a very steep rise during the heating period with an occasionally severe over-control and unexplainable temperature jumps. Furthermore, shocks and noises were noted, the center of which was the evaporator partially filled with the heat transfer fluid. The latter was thought to be a phenomenon similar to the boiling delay (bumping) often observed in distillations or evaporation. In another experimental arrangement in which both the surface of the liquid phase of the heat transfer fluid and also the bubble formation in the liquid and on the heating elements could be observed, the hypothesis was confirmed. It was possible to establish that, upon switching on of the electric heating system, the bubbles were not uniformly formed in the liquid. Rather the bubbling took place very suddenly and was associated with severe manifestations of turbulence, in which the turbulences, proceeding from one place, spread over the entire length of the heating apparatus and set the surface of the liquid in a strong wave-form movement.

It is generally known that a boiling delay occurs in a very pure and completely degassed liquid—because of the presence of few highly active centers or nucleus centers for bubble formation during the evaporation of a pure and degassed liquid. Upon the formation of the first gas bubble and because of the extremely good heat transition from the liquid to the bubble, the latent superheat is consumed in a short time for formation. As a result a pressure wave can arise and can even lead to damage or destruction of the heating system. The objectives of the invention are to provide measures so that damage to the heating apparatus as a result of boiling lag (bumping), on the one hand, is prevented, to provide measures whereby the phenomenon of boiling lag is suppressed insofar as possible.

The technical difficulties in this connection lay in that the measures hitherto proposed for combatting the causes were unsuitable, because the required purity of the heat-transfer fluid is difficult to maintain and because in the course of time accumulations of uncondensable gases, which can be removed only with great expenditure, occur in the heating system.

Thus, for example, providing porous bodies in the evaporator to prevent the thermodynamically metastable equilibrium and to promote the nuclei formation for the vapor bubbles in the liquid, these bodies being active until the air included in the pores is used up, was rejected as unsuitable, as was, according to another proposal, generating gas bubbles in the fluid by electrolysis.

THE INVENTION

For the solution of the problems underlying the invention, the invention herein provides, for heating systems of the type described above, that the evaporator be provided with several vertical, transverse, axially spaced baffleplate walls with openings for throughflow of the heating agent, the baffle-plate walls extending above the phase limit of the heat transfer liquid level's penetration into the vapor space. It is advantageous to provide baffle-plate walls between each of the branch pipe lines extending between the fluid-heating manifold and convexly curved, yarn-heating profile tubes or the jacket tubes for the tubular yarnheating tubes.

Though the boiling delay is not, to be sure, prevented, the evaporator of the heating apparatus to distinct advantage is subdivided into several sections by the baffleplate walls. These sections have common communication on the upper, vapor-side, but are substantially separated on the lower liquid side. Thus, the pressure wave or the associated wave movement, arising at any place in the liquid from the spontaneous vapor bubble formation, is effectively damped at the liquid surface, its spread is locally and effectively limited and upward surge of the disturbance is prevented.

For the construction of the baffle-plate walls, according to a further proposal of the invention, care should be taken that the entire heating liquid-moistened cross section of the evaporator be maintained by a liquid level which covers the heating surfaces when the heating apparatus is cool and thereafter heated to the intended operating temperatures. Depending on how many reflux lines are provided for the return of the condensate in the condenser to the evaporator, measures must be taken for a rapid balancing of the liquid level and a uniform distribution of the condensate in the evaporator. By so doing, the heating members, for example electrical resistance heating elements or the like, are moistened at least with a film of the heat-transfer liquid and in no case can burn out. For this function, the invention provides, on or near the border of each baffle-plate wall at least one recess below the vapor-liquid phase limit, through which the axial series of sections of the evaporator are in communication. These recesses lie, in an advantageous arrangement of the baffle-plate walls, at various levels of the evaporator, i.e., not in immediate succession or successive alignment.

For improvements in the the prevention of excessively severe overheating of the liquid heat carrier as a result of too few nuclei for the vapor bubble formation the heating means extending in axial direction of the evaporator is surrounded in the zones between the baffle-plate walls by a regularly perforated structure, preferably a screen or perforated plate means. The free space between the perforated structure and the heating advantageously is filled with pieces having a great specific surface, preferably, wire coils, lathe shavings, sharp-edged sheet metal cuttings or the like. There can also be provided in the liquid-moistened space of the evaporator either wire gauze, a tangled fleece of a material that is stable with respect to the heat transfer means at the intended operating temperature or a layer of expanded metal.

With these various measures, a large number of sharp corners and edges with preferably small radii of curvature are provided and can function as active centers on which the vapor bubbles can form early, or at which the transition of the unstable, superheated liquid is catalyzed into the stable vapor state, whereby, despite the use of a pure, completely degassed heat transfer fluid, the otherwise usual boiling lag or bumping is largely prevented.

The invention is explained in further detail in the following description, together with the drawings, of preferred embodiments of the invention.

Figure 1:
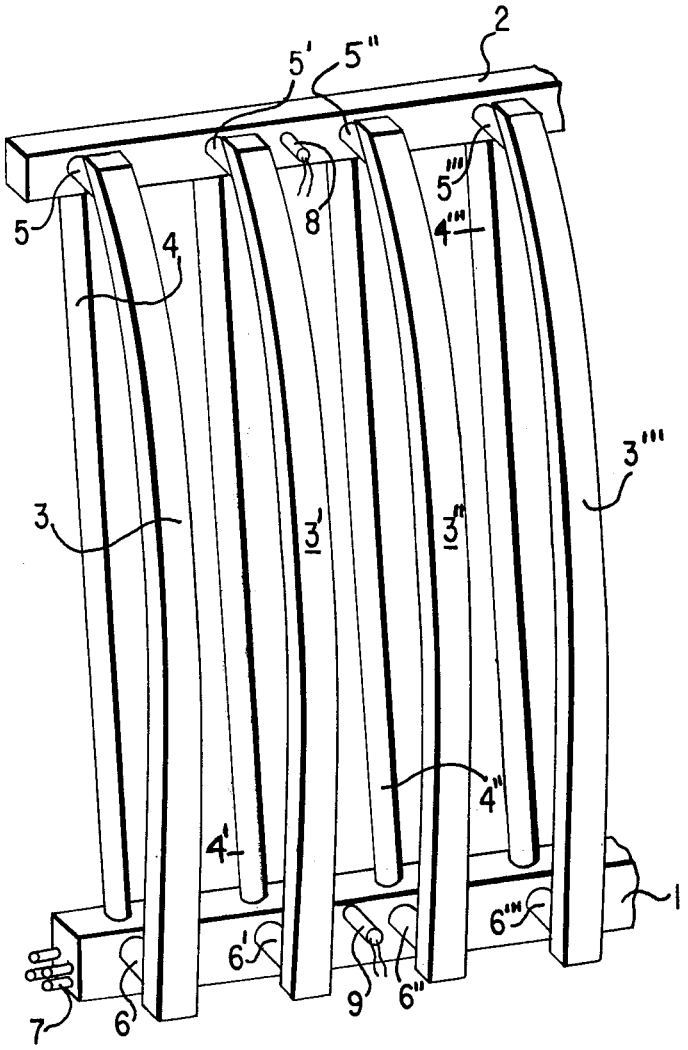
FIG. 1 is a front perspective view of a heating unit for the heat treatment of yarns.

The heating system of FIG. 1 for the heat treatment of synthetic yarns consists of an evaporator shell or tube 1 partially filled with the heat transfer liquid, the condenser shell or tube 2 above and substantially parallel thereto, the profile tubes 3, 3′, 3″, 3‴ forming yarn contact surfaces at their convexly curved front sides, and the condensate return lines or tubes 4, 4′, 4″, 4‴. The connection between the evaporator 1, the condenser 2 and the profile tubes 3 is established in each case by upper and lower branch tube lines 5, 5′, 5″, 5‴ and 6, 6′, 6″ and 6‴, respectively. It is not necessary, however, to provide condensate return tubes or lines 4 in correspondence to the number of profile tubes 3. The return tubes or lines can be replaced by a single tube or pipe which is dimensioned in the requisite cross section and the lower end of which is immersed below the liquid level of the heat transfer liquid.

The heating unit according to FIG. 1 operates as follows:

In the substantially closed system (substantially freed of inert vapors or gases by evacuation) the evaporator 1 is filled at least up to the lower branch tube lines 6 with the heat transfer fluid. Depending on the treatment temperature intended for the yarns, the closed system optionally is under vacuum or a slight excess pressure at STP. The heat transfer fluid is heated by heating means, for example the electric resistance heating elements or rods 7 extending longitudinally through the evaporator 1. The switching on and off of the electric current for the heating means is accomplished by a temperature control with PD behavior, not represented in detail, which compares the selected desired temperature value with the actual temperature value determined in the heating unit by the resistance thermometer 8 in the condenser 2 or the thermoelement 9 (FIG. 4) in the evaporator 1 and readjusts any deviations. In the substantially closed state of the liquid-vapor system, there is essentially solely a particular vapor pressure associated with the desired temperature value of the heat carrier. The yarn contact surfaces over which the yarns to be treated are continuously conducted occurs as a result of the temperature gradient between yarn contact surfaces and yarn, this amount of withdrawn heat is immediately balanced from the internal energy of the heating medium vapor. The vapor, in giving off its heat of evaporation, is partially condensed. Upon removal of the remaining heat of evaporation in the condenser 2, the heating medium's vapor is liquified therein, and the condensate, under the effect of gravity, flows back through the condensate return lines 4 into the evaporator.

With the condensation of the vapor in the condenser 2 there is a very large volume contraction with decrease of the local pressure. The pressure gradient between evaporator 1 and condenser 2, however, is essential as driving force for the flow of heat carrier vapor through the profile tubes 3 and for the heat transfer to the yarn contact surfaces. Through suitable dimensioning of the flow-through cross sections, especially of the cross sections of the profile tubes 3 and of the upper branch pipe lines 5, as well as of the surface of the condenser 2 (which, if need be, can be enlarged by means of an additional, optionally ventable condenser, for example according to German published patent application No. P 22, 12,678), all the yarn contact surfaces are very uniformly heated at the chosen temperature.

Figure 2:
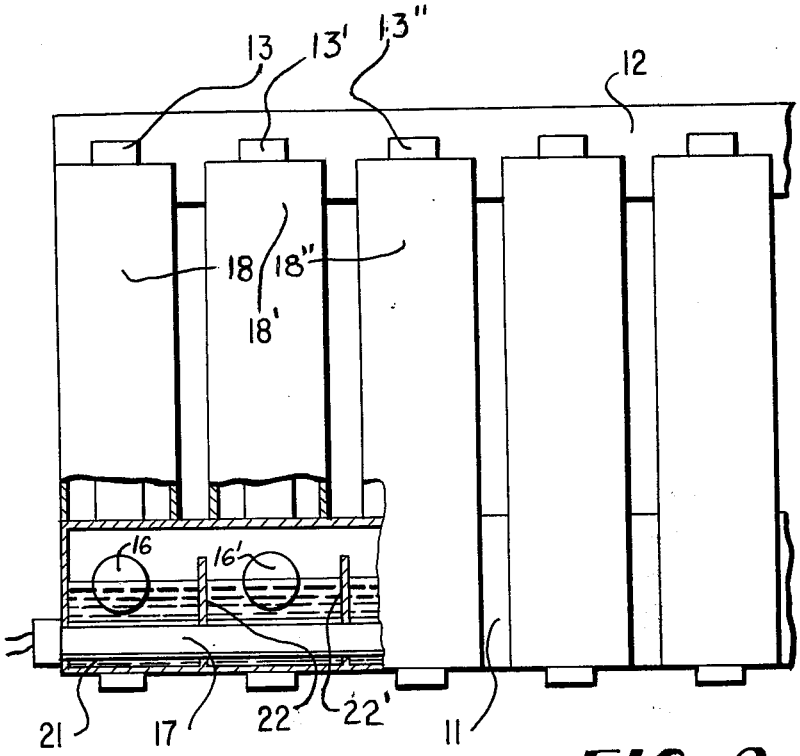
FIG. 2 is a side elevation of another heating unit for the treatment of yarns, in which, for the clarity of illustration, the evaporator is partly broken away.
Figure 3:
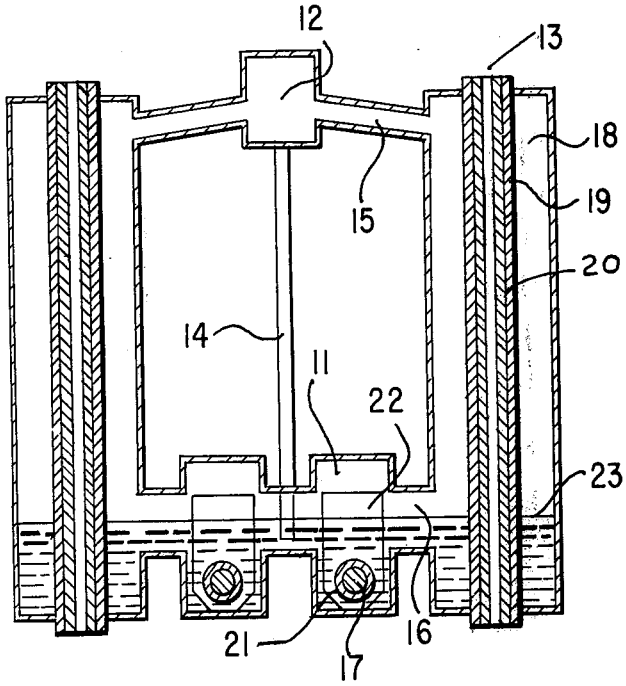
FIG. 3 is a transverse cross sectin of a heating unit like that of FIG. 2 with yarn treatment places positioned symmetrically on opposite sides of the longitudinal axis of the unit.

In FIGS. 2 and 3 there is represented a heating system likewise operated with condensing of heat transfer medium vapors. It has yarn heat treatment units on both sides of its longitudinal axis, which units are arranged in mirror-image pattern to the longitudinal axis of the heating system. The heating system consists, analogously to FIG. 1, of an evaporator tube or shell 11, a condenser tube or shell 12, condensate reflux lines or tubes 14 as well as symmetrically arranged upper and lower branch pipe lines or tubes 15 and 16. The essential differences with respect to the heating system illustrated in FIG. 1 are instead of the straight or preferably convexly curved profile tubes 3, 3′, 3″, 3‴ over which yarn to be treated is conducted under tension, the heating system according to FIG. 2 and FIG. 3 has a plurality of thread guide tubes 13 extending longitudinally through thermally insulated jacket tubes 18 and heated over at least a part of their length involved in the passage of the yarns through the heating system. In a preferred embodiment of this heating system, the thread guide tubes 13 consist of tubes 19 tightly welded into the jacket tubes 18 and inner tubes 20 fitted snugly into the tubes 19 with only slight manufacturing tolerance. The inner, preferably thin-walled tubes 20, through which the yarns are conducted substantially without contact, are exchangeable, which is highly advantageous and desirable in the case of a fouling of the inner tube surface by finishing agents or the like or for the cleaning of the heat transfer surfaces. Evaporation of the heat transfer fluid in the evaporator 11 is provided by electrical heating elements 17. These, in the illustrated embodiment of FIG. 3, are seated with little radial play in protective tubes 21 and are, therefore, easily changeable. The protective tubes 21 are welded (not shown) to one end wall of the evaporator 11 or are secured therein at least by spaced spot welds. On the other end wall which they penetrate, the protective tubes 21 are welded by gastight and vacuum tight welds.

The constructions of the evaporator 1 or 11 are governed according to the pressures occurring in the various operating phases, and must take into account that occasionally a high vacuum of only a few mm Hg absolute can occur in the heating system. It is advantageous, therefore, for the avoidance of deformations or for the achieving of rigidity and stability of the evaporator shell often found to be necessary, to round out the edges of the plates or sheet metal parts in a suitable manner and to provide reinforcements in the interior. It can also be advantageous—as represented in FIG. 3—to provide, instead of a single evaporator, several smaller, communicating tubes, to each of which tube is allocated corresponding heating means 17.

According to the invention, the evaporator 1, 11 has, lying transversely to its longitudinal axis, several, axially spaced baffle-plate walls 22, 22′, etc., with openings for the heating means 7, 17 extending along the evaporator, or the protective tubes 21. The upper edges of the baffle-plate walls 22 extend beyond the phase limit 23 between the heat transfer fluid and the vapor space.

The baffle-plate walls 22, 22′, etc., are arranged in an advantageous manner between each pair of adjacent connections of branch pipe lines 6, 6′, 6″, etc. for the curved profile tubes 3, 3′, 3″, etc., or for the jacket tubes 18, 18′, 18″, etc., of the yard-conducting, heating tubes 13, 13′, 13″., etc.

Figure 4:
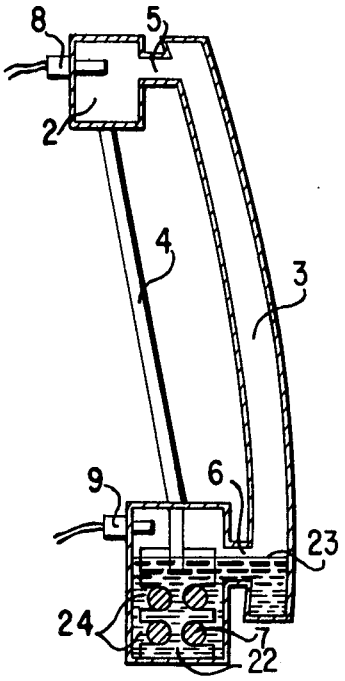
FIG. 4 is a semi-diagrammatic cross section of a heating unit according to FIG. 1.

FIG. 4 shows in cross section a heating system like that of FIG. 1. Instead of the openings for the heating means 7, recesses or notches 24 are provided in the baffle-plate wall 22. These recesses 24 extend to the outer border or edge of the baffle-plate wall, whereby the sections into which the baffle -plate walls 22, 22′, etc. subdivide the evaporator in its longitudinal direction, are in communication on liquid side, whereby the condensate flowing back over the condensate return line 4 or 14 into the evaporator is uniformly distributed therein.

Figure 5:
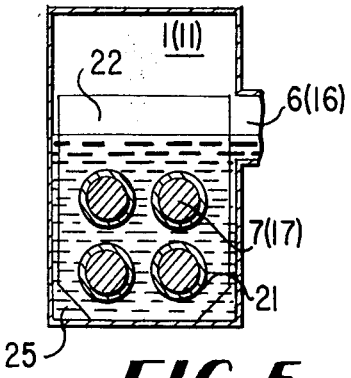
FIG. 5 is a transverse cross section through the evaporator of the heating unit on a larger scale.
Figure 6:
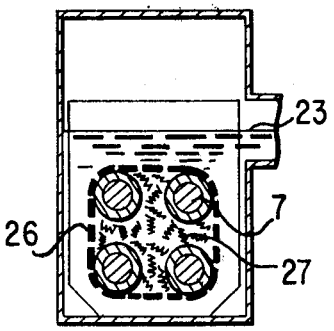
FIG. 6 is a similar transverse cross section of the evaporator, in which the heating means are surrounded by a perforated wall tube of substantially rectangular cross section, e.g., a screen tube or perforated metal tube.

In FIG. 5 there is shown the cross section of the evaporator with a baffle-plate wall 22 of similar construction. The resistance heating elements 7 and 17 are positioned in protective tubes 21 and, therefore, are exchangeable. The baffle-plate wall 22 has—for the uniformity of the liquid level over the length of the evaporator—openings 25 formed by diagonal cuts at lower corners for flow of the heat transfer fluid between adjacent sections. According to FIG. 6, the heating means 7 are surrounded by a screen or perforated wall tube 26. The free space between the latter and the resistance heating elements 7 is filled wire coils 27 of suitable materials, for example stainless steel wire, in order to provide additional nuclei places for the vapor bubble formation as a consequence of the large specific surface, thereby decreasing the overheating of the liquid heat transfer fluid.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendant advantages, the forms herein disclosed being preferred embodiments for the purpose of illustrating the invention.

The invention is hereby claimed as follows:

1. Heating apparatus for the heat treatment of synthetic yarns having a substantially closed liquid-vapor system operable under the vapor pressure of an evaporable and condensable heat-transfer medium, comprising an evaporator member extending in axial direction of the apparatus, filled at least partly with liquid heat transfer medium; electric resistance heating elements extending axially through said member; a plurality of yarn-heating, substantially vertical tubes having heat conductive, yarn-heating surfaces heatable by the vapors of the heat transfer medium for the heat treatment of the yarns passing along said surfaces; a condenser above and positioned substantially parallel to the evaporator member, for collecting the condensed heat transfer medium vapors; branch tube means for the communication of all of the respective tubes with both the evaporator member and the condenser for flow of vaporized heat transfer material from said evaporator member to the condenser through said tubes; and at least one return line for returning condensate collected in the condenser to the evaporator member, the improvement comprising at least several, axially spaced, baffleplate walls positioned transversely in the evaporator member with openings therein through which extend said heating elements, passage means providing liquid communication between the spaces in said evaporator member between the baffle plates, the baffle-plate walls extending upwardly beyond the phase boundary between the liquid heat transfer medium and the vapor space in said evaporator member, and said baffle plate walls being at least substantially coextensive with the entire, liquid moistened, cross section of the evaporator member which is axially traversed by said heating elements for effectively damping any local pressure waves created between the adjacent baffle-plate walls.

2. Heating apparatus according to claim 1, wherein said passage means is at least one recess in the edge of each baffle-plate wall for permitting restricted flow of liquid heat transfer medium across the baffle-plate walls.

3. Heating apparatus according to claim 1, wherein the heating elements extending in axial direction of the evaporator member are surrounded in the zones between the baffle-plate walls by respective perforate members.

4. Heating apparatus according to claim 3, wherein the free space between the perforate members and the heating elements is filled with metal pieces having a great specific surface.

5. Heating apparatus according to claim 4, wherein said pieces are selected from the group consisting of wire coils, lath shavings and sharp-edged sheet metal cuttings.

6. Heating apparatus according to claim 1, wherein the liquid-moistened space of the evaporator member contains a member selected from the group consisting of wire gauze, an expanded metal layer, and a tangled fleece of a material which is inert with respect to the heat transfer means at the intended operating temperatures.

7. Heating apparatus for the heat treatment of synthetic yarns having a substantially closed, liquid-vapor system operable under the vapor pressure of an evaporable and condensable heat-transfer medium, comprising an evaporator member extending in axial direction of the apparatus, filled at least partly with liquid heat transfer medium, electric resistance heating elements extending axially through said member; a plurality of yarn-heating, substantially vertical tubes having heat conductive, yarn-contact surfaces heatable by the vapors of the heat transfer medium for the heat treatment of the yarns passing along said surfaces; a condenser above and positioned substantially parallel to the evaporator member, for collecting the condensed heat transfer medium vapors; branch tube means for the communication of all of the respective tubes with both the evaporator member and the condenser for flow of vaporized heat transfer material from said evaporator member to the condenser through said tubes; and at least one return line for returning condensate collected in the condenser to the evaporator member, the improvement comprising at least several, axiallly spaced, baffle-plate walls positioned transversely in the evaporator with openings therein through which extend said heating elements, passage means providing liquid communication between the spaces in said evaporator member between the baffle plates, the baffle-plate walls extending upwardly beyond the phase boundary between the liquid heat transfer medium and the vapor space, one of said baffle-plate walls being positioned between each adjacent pair of connections to said evaporator of respective branch tube means for the respective tubes, and said baffle-plate walls being at least substantially coextensive with the entire liquid-moistened cross-section of the evaporator member traversed by said heating elements for effectively dampening any local pressure waves of said liquid heat transfer medium created between adjacent baffle-plate walls.

* * * * *